United States Patent [19]

Angell

[11] Patent Number: 4,539,983

[45] Date of Patent: Sep. 10, 1985

[54] RESPIRATOR SPEECH TRANSMITTER

[75] Inventor: Cyril E. N. Angell, Trowbridge, England

[73] Assignee: Avon Industrial Polymers Limited, Wiltshire, England

[21] Appl. No.: 523,066

[22] Filed: Aug. 15, 1983

[30] Foreign Application Priority Data

Aug. 18, 1982 [GB] United Kingdom ..... 8223825
May 20, 1983 [GB] United Kingdom ..... 8314065

[51] Int. Cl.[3] ..... A62B 7/00

[52] U.S. Cl. ..... 128/201.19; 181/21; 181/22

[58] Field of Search ..... 128/201.19, 205.12, 128/200.18, 911; 181/21, 22, 188

[56] References Cited

U.S. PATENT DOCUMENTS

| | | | |
|---|---|---|---|
| 260,358 | 7/1882 | Bennett | 181/21 |
| 1,672,595 | 6/1928 | Youngblood | 181/22 |
| 3,124,130 | 3/1964 | Klinger | 128/201.19 |
| 3,348,537 | 10/1967 | Miller et al. | 128/201.19 |
| 4,249,527 | 2/1981 | Ko et al. | 128/911 |

FOREIGN PATENT DOCUMENTS

| | | | |
|---|---|---|---|
| 833096 | 7/1938 | France | 128/201.19 |
| 464458 | 4/1937 | United Kingdom | 128/201.19 |

*Primary Examiner*—Henry J. Recla
*Attorney, Agent, or Firm*—William R. Hinds

[57] ABSTRACT

A respirator speech transmitter has a projecting tube with a one-way valve at one end and the other end being covered by a baffle having an inner skirt extending around the tube. An outer skirt extends from the tube to surround the inner skirt so that an annular convoluted passageway which increases in annular width as it extends from the tube formed between the outer surface of the tube, the inner skirt and the outer skirt. This convoluted passageway has excellent acoustic properties yet prevents ingress of contaminants. In a modification the valve is at the same end of the tube as the baffle.

10 Claims, 7 Drawing Figures

RESPIRATOR SPEECH TRANSMITTER

BACKGROUND OF THE INVENTION

Field of the Invention

There is a need to allow the wearer of a respirator to speak normally to others without unduly impairing the volume or clarity of his speech. At the same time, it is obvious that there must be no leak path into the respirator through the speech transmitter, and the reconciling of these two requirements present considerable difficulties.

SUMMARY OF THE INVENTION

According to the invention we provide a speech transmitter for a respirator wherein a tube fitted with a uni-directional escape valve is surrounded at at least one end by the skirt of a baffle and this skirt is itself surrounded by an outer skirt. Thus soundwaves produced by the wearer of the respirator and causing air vibration passes as such vibration through the uni-directional valve, passes out of the tube and enters into an annular convoluted passageway construction formed by the outer wall of the projection, the skirt of the baffle and the outer skirt. The passageway increases in annular width as it extends from the end of the tube, and this forms a divergent horn having desirable audio properties. In a preferred embodiment the tube is frusto conical, tapering convergently away from the wearer and the skirt of the baffle is correspondingly frusto conical of a greater angle of taper thus forming the divergent horn between the outer wall of the tube and the skirt of the baffle and the valve is a plate-like element which because of its conformation generates vibration in the horn construction.

A front face of the baffle placed in front of the valve of the projection may be a stout protective wall and may include an inwardly directed boss partly extending into the tube whereby to define a throat between itself and the tube which is also the throat of the horn construction. The boss may be inwardly tapering. It occupies a predetermined portion of the volume inside the tube and outside the valve, predetermined to optimise both the protection factor and the acoustic performance of the respirator. The baffle may incorporate a pick-up for audio equipment. Alternatively, the front face of the baffle may be a low mass diaphragm which while partially protecting the tube and the valve in it, can also act as an onward transmitter of the sound vibration.

The complete transmitter may be formed as a discrete unit for insertion into the face piece of a respirator and sealing thereto.

BRIEF DESCRIPTION OF THE DRAWINGS

Two embodiments of the invention will now be described in detail, by way of example, with reference to the accompanying drawings, in which.

DETAILED DESCRIPTION

Figure 1:
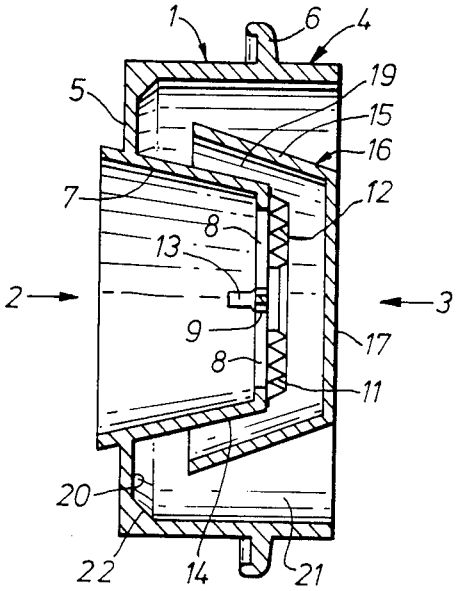
FIG. 1 is a diametrical section through a first embodiment of a speech transmitter according to the present invention.

Referring first to the embodiment of FIGS. 1 to 4 a speech transmitter assembly 1 has an outer skirt 4 which is cylindrical with an annular flange 5 at one end. This is the end which is inward in use, nearer to the mouth of the wearer of a respirator of which the face piece may be clamped to an outward flange 6 of the skirt 4. Within the flange 5 there is formed an outwardly narrowing frusto conical tube 7 at the outward end of which are apertures 8 with a central hub 9 supported by spiders 10. A uni-directional valve 11 has a plate of rubber or other elastomer on which are formed concentric ridges seen as a concertina section 12 in FIG. 1 is secured to the central boss 9 by a peg projecting through an aperture in it and held by an entrapping end cap 13. The edges of the plate abut but are not attached to a flange at the end of the tube 7 and so air can escape from the respirator past those edges.

Figure 3:
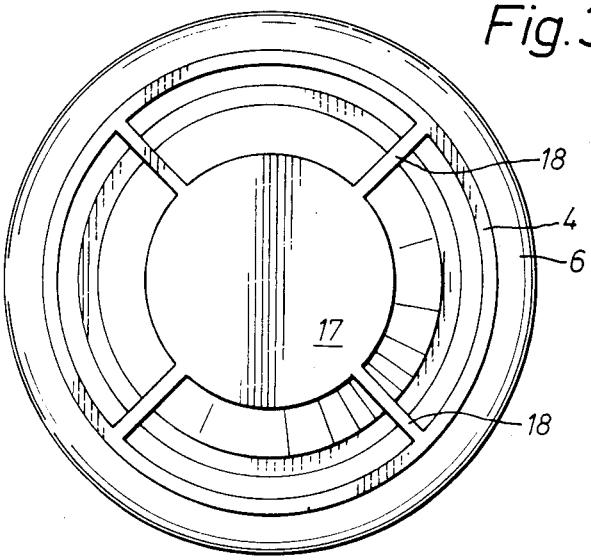
FIG. 3 is a view on the arrow 3 of FIG. 1.

Outside the outer wall 14 of the frusto conical tube 7 there is a frusto conical skirt 15 of a baffle 16 which in FIG. 1 has an end wall 17 of rigid material covering which thereby protects the outer face of the valve 11. The baffle is positioned by spiders 18 permanently or temporarily projecting inwardly from the outward end of the skirt 4 (FIG. 3).

It will be seen that the conicity of the skirt 15 is not the same as that of the outer surface 14 of the tube 7 but is slightly greater, thereby forming between the two an annular passage 19 which increases in its radial or annular width in the direction away from the front of the baffle and towards the inner surface 20 of the flange 5 of the assembly. Furthermore, an annular passage 21 formed between the outer wall of the baffle 15 and the inner wall of the skirt 4 of the assembly also increases in its radial or annular width as it progresses towards the outside of the assembly. An infill 22 in the corner between the skirt 4 and the flange 5 both strengthens that corner and further improves the acoustic properties of the continuously divergent horn-like channel formed by these parts in the progressing from the valve 11 to the open air beyond the open end of the channel part 21. This is in effect the shape of a folded exponential horn.

The baffle with its spiders 18 is suitably formed separately from the rest of the transmitter assembly so it can be snapped or screwed onto the front of the skirt 4. This would allow ready access as desired to the outside of the valve projection to allow replacement or decontamination of the valve.

Figure 4:
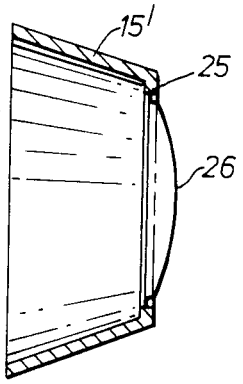
FIG. 4 shows a partial diametrical section corresponding to FIG. 1 but illustrating an alternative baffle.

In the modification seen in FIG. 4, the baffle has the same frusto conical skirt 15' but into a small flange 25 of this is sealed a very low mass diaphragm 26. Since this diaphragm has no sealing function it can be of any low mass specifically chosen for its desirable acoustic properties. Furthermore, it or a similar entity could form the input to an audio system such as a microphone.

The positioning of the valve at the end of the tube 7 increases the gas-containing space within the respirator behind the outlet valve, and spaced the valve away from the face of the wearer, which is in itself desirable and also provides a certain amount of resonant cavity behind the valve 11, which is desirable from the point of view of speech quality.

Figure 2:
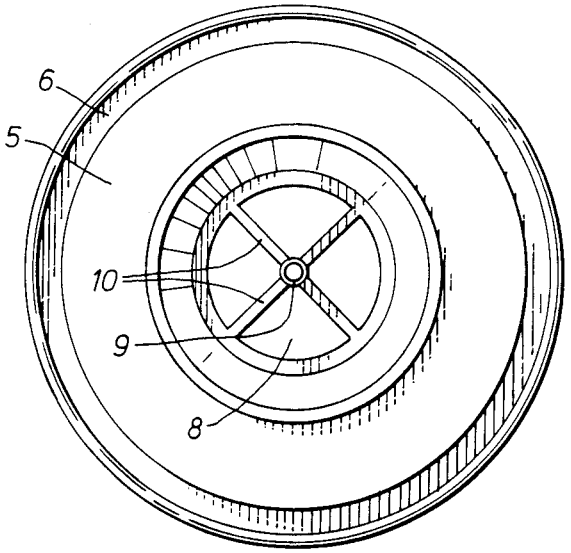
FIG. 2 is a view on the arrow 2 of FIG. 1.
Figure 5:
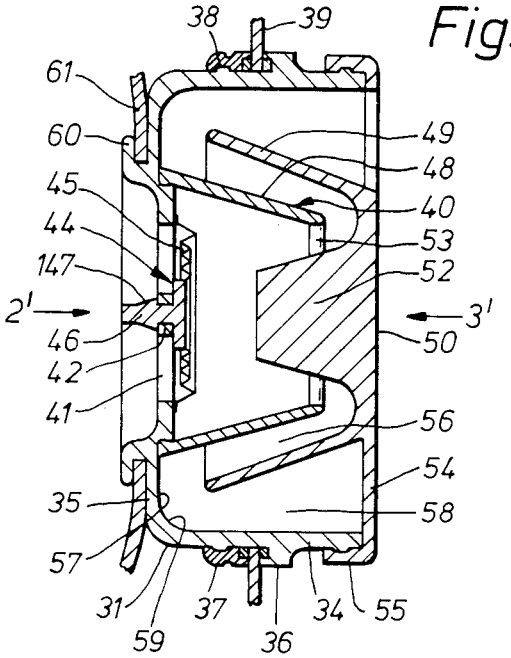
FIG. 5 is a diametrical section through a second embodiment of a speech transmitter according to the present invention.
Figure 6:
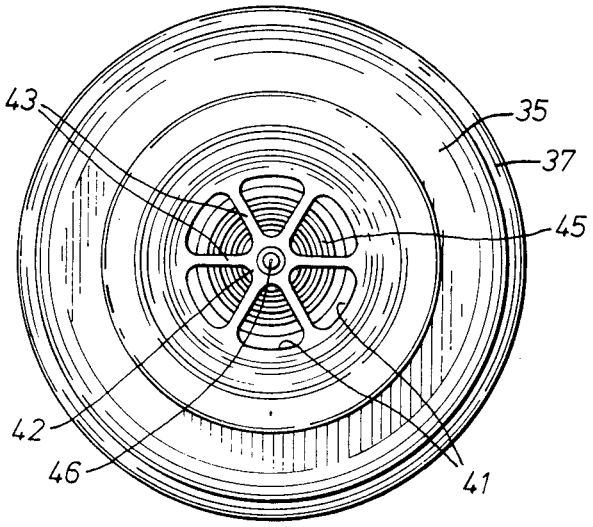
FIG. 6 is a view on the arrow 2' of FIG. 5.
Figure 7:
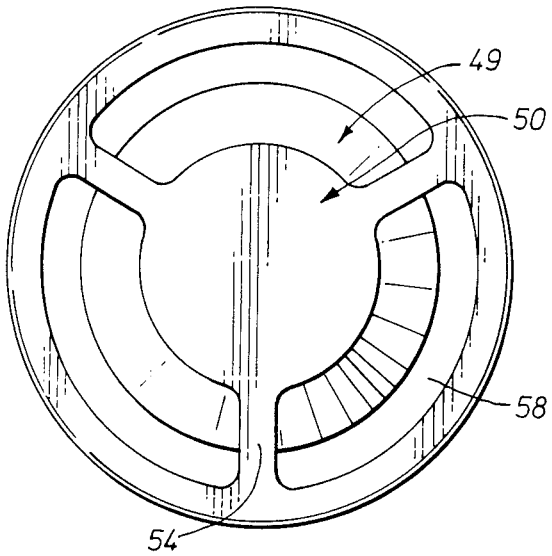
FIG. 7 is a view on the arrow 3' of FIG. 5.

The embodiment of FIGS. 5 to 7 which is at present the preferred embodiment is generally similar to that of FIGS. 1 to 3, except in the position of the valve. The speech transmitter assembly 31 has a cylindrical outer skirt 34 with an annular flange 35 at the end which is inward in use. The facepiece 39 of a respirator may be clamped to an outward flange 36 of the outer skirt 34 by means of a ring 37 pressed axially onto a detent rib 38. Within the flange 35 there is snap-fitted an outwardly narrowing frusto conical tube 40 within the inward end of which are formed, in the flange 35, apertures 41 with a central hub 42 supported by spiders 43. The valve 44 has a plate of rubber or other elastomer on which are formed concentric ridges seen as a concertina section 45 in FIG. 5 is secured to the central boss 42 by an integral rubber peg 46 which when stretched can be pulled through an aperture in it but which when relaxed is held by an entrapping enlargement 47. Thus the valve 44 of this second embodiment is at the opposite end of the tube to that of the first embodiment. The edges of the plate are not attached to the margin of the flange 35 in the tube 40 and so air can escape from the respirator past those edges. This gives the possibility of "dynamic leakage", as distinct from static leakage, backwards during the time that the valve is open and particularly just as it closes at the end of a transmission of vibration.

The positioning of the valve at the base of the projection 40 increases the gas-containing space within the horn beyond the outlet valve. This is then controlled by the partial filling of the volume inside the projection by the boss 52. There is a compromise to be struck between the increased security from the point of view of dynamic leakage given by a high-volume and labyrinthine passage beyond the valve and the loss of acoustic quality in such a passage. We find that the provision of a reasonable free volume within the projection as shown, with a restriction at 53 forming the throat of the horn can give a protection factor of $10^5$ or better in dynamic leakage—that is to say protection to the extent of at most 10 ppm of contaminant passing backwards past the valve—without loss of acoustic quality. Therefore the second embodiment is preferable to the first embodiment.

Outside the outer wall 48 of the frusto conical tube 40 there is a frusto conical inner skirt 49 of a baffle 50 having an end wall 51 of rigid material of which a boss 52 projects into the projection 40 forming a throat 53. The baffle thereby protects the outer face of the valve 44. The baffle is positioned by spiders 54 projecting inwardly from a flange 55 which is snap-fitted onto the outward end of the outer skirt 34.

As in the first embodiment, the conicity of the inner skirt 49 is not the same as that of the outer surface 48 of the tube 40 but is slightly greater, thereby forming between the two a passage 56 which increases in its radial width in the direction away from the front of the baffle and towards the inner surface 57 of the flange 35 of the assembly. Furthermore, a passage 58 formed between the outer wall of the inner skirt 49 and the inner wall of the outer skirt 34 of the assembly is also increasing in its radial width as it progresses towards the outside of the assembly. Rounding 59 in the corner between the outer skirt 34 and the flange 35 is provided for the same reasons as the infill 22 in FIG. 1.

The snap-fitting of the baffle 50 and the tube 40 allows ready access as desired to the outside of the valve to allow replacement or decontamination of the valve.

On the back face of the flange 35 there is means for the reception of an airguide 61, in this case an overhanging flange 60. The airguide may be acoustically matched.

The baffle could include the input to an audio system such as a microphone.

It can be seen that the only non-rigid part of the assembly is the valve (and optionally a diaphragm as in FIG. 4), all the rigid parts may be formed by a simple operation from metal or from thermoplastic or themosetting plastics materials. Their rigidity apart from giving a desirable strength also means that they do not substantially cause loss of energy from the speech.

What is claimed is:

1. A speech transmitter for a respirator comprising:

a hollow tube having a first open end for facing outwardly of the respirator and a second open end for facing inwardly of the respirator nearer to the mouth of a user;

a baffle spaced from and extending over said first open end of said hollow tube, said baffle having an inner skirt extending around at least a part of said tube;

an outer skirt extending from said tube around said inner skirt; the outer surface of said hollow tube, said inner skirt, and said outer skirt defining an annular convoluted passageway extending from said first open end of said tube, said annular passageway increasing in annular width as it extends from said first open end of said tube; and uni-directional valve means located in said transmitter for permitting air flow through the tube in the direction from the second end to the first end and then into said convoluted passageway.

2. A speech transmitter according to claim 1, wherein said tube is frusto-conical in cross-section, said frusto-conical tube tapering towards said first open end of said tube.

3. A speech transmitter according to claim 2, wherein said inner skirt is frusto-conical in cross-section, said frusto-conical inner skirt tapering in the same direction as said frusto-conical tube, the angle of taper of said frusto-conical inner skirt being greater than the angle of taper of said frusto-conical tube.

4. A speech transmitter according to claim 1, wherein said uni-directional valve means is located at said second open end of said tube.

5. A speech transmitter according to claim 1, wherein said uni-directional valve means is located at said first open end of said tube.

6. A speech transmitter according to claim 1, wherein said baffle is rigid.

7. A speech transmitter according to claim 6, wherein said baffle has a boss extending therefrom into said tube.

8. A speech transmitter according to claim 7, wherein said boss tapers as it extends into said tube.

9. A speech transmitter according to claim 1, wherein a part of said baffle is a flexible diaphragm, said flexible diaphragm extending over said first open end of said tube.

10. A speech transmitter according to claim 1, wherein said uni-directional valve means comprises:

an annular flange projecting radially into said tube to define an aperture at one end of the tube;

a resilient plate, the periphery of said resilient plate abutting against said flange, air movement through said aperture parting said periphery of said plate from said flange; and a plurality of spiders connecting a central part of said plate to said flange.

* * * * *